United States Patent [19]

Cherrington

[11] 4,003,440

[45] Jan. 18, 1977

[54] APPARATUS AND PROCESS FOR DRILLING UNDERGROUND ARCUATE PATHS UTILIZING DIRECTIONAL DRILL AND FOLLOWING LINER

[75] Inventor: Martin D. Cherrington, Carmichael, Calif.

[73] Assignee: Tidril Corporation, Sacramento, Calif.

[22] Filed: Sept. 17, 1974

[21] Appl. No.: 506,920

[52] U.S. Cl. ..... 175/61; 175/171

[51] Int. Cl.[2] ..... E21B 7/04

[58] Field of Search ..... 175/61, 62, 171, 172, 175/173, 170, 45, 73, 75, 101, 103, 107

[56] References Cited

UNITED STATES PATENTS

| | | | |
|---|---|---|---|
| 2,165,666 | 7/1939 | Tilly | 175/62 X |
| 2,565,794 | 8/1951 | Young | 175/61 |
| 2,684,229 | 9/1954 | Bergstrom | 175/171 X |
| 2,950,087 | 8/1960 | Gregory | 175/171 X |
| 3,231,032 | 1/1966 | Genberg et al. | 175/171 |
| 3,390,730 | 7/1968 | Techy et al. | 175/171 |
| 3,587,756 | 6/1971 | Adkins et al. | 175/61 |
| 3,610,346 | 10/1971 | Ziober | 175/61 |
| 3,703,212 | 11/1972 | Abrahams | 175/171 X |
| 3,713,500 | 1/1973 | Russell | 175/73 |
| 3,720,272 | 3/1973 | Hunter | 175/75 |
| 3,732,143 | 5/1973 | Joose | 175/101 X |
| 3,767,836 | 10/1973 | Geis et al. | 175/61 X |
| 3,840,079 | 10/1974 | Williamson | 175/61 |

FOREIGN PATENTS OR APPLICATIONS

| | | | |
|---|---|---|---|
| 1,315,879 | 11/1961 | France | 175/171 |

*Primary Examiner*—James A. Leppink
*Attorney, Agent, or Firm*—Townsend and Townsend

[57] ABSTRACT

A motor-powered directional drill is advanced in an inverted arcuate path underneath an obstacle such as a water course. A second concentric and larger lining pipe follows the advance of the directional drill either simultaneously but preferably sequentially to form a concentric annulus about the directional drill. This lining pipe preserves the directional drilling path made and prevents the collapse or the erosion of the hole due to manipulation of the directional drill. When the inverted path underneath the obstacle is completed and the liner extends the full length, the liner becomes a large diameter pipe of improved tortional capability which can be used subsequently to ream the hole to full size for placement of a production casing. A specialized drilling rig is provided having one advancing chuck for crowding the directional drill into the ground and another larger rotating chuck to rotate and advance the following lining pipe into the ground concentrically about the directional drill.

13 Claims, 7 Drawing Figures

FIG_4
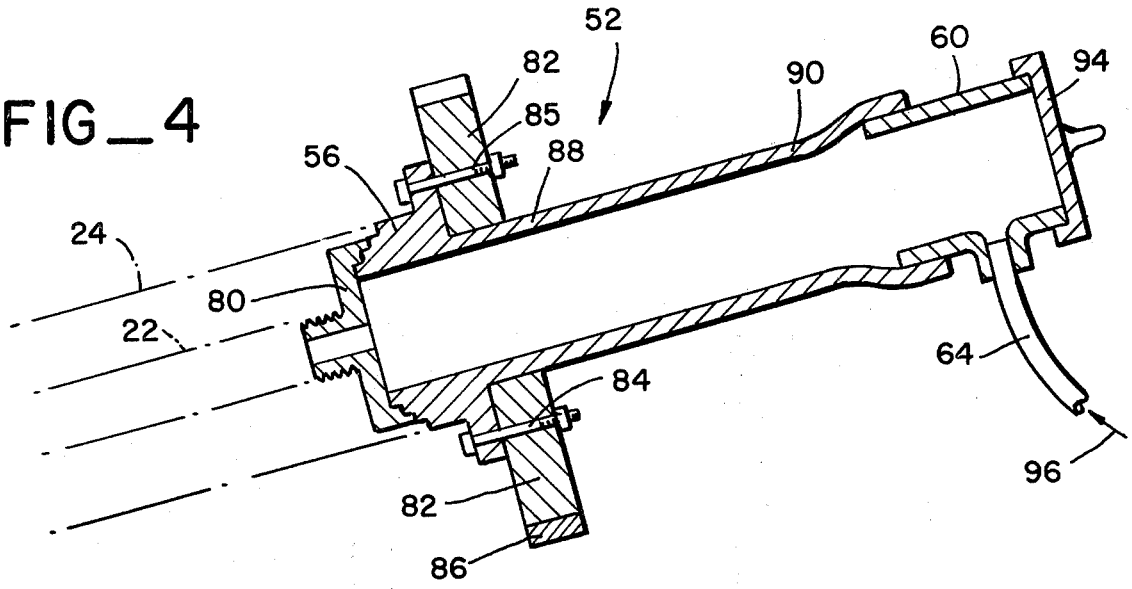
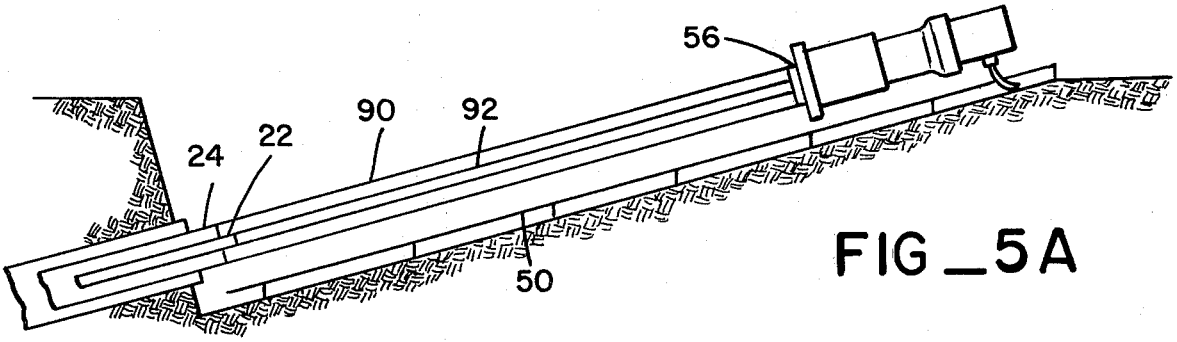
FIG_5A
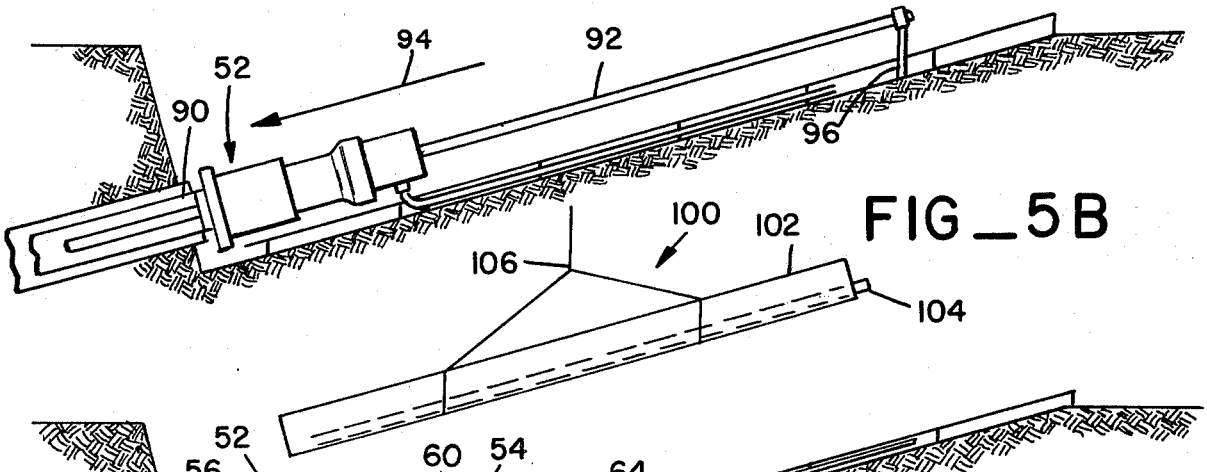
FIG_5B
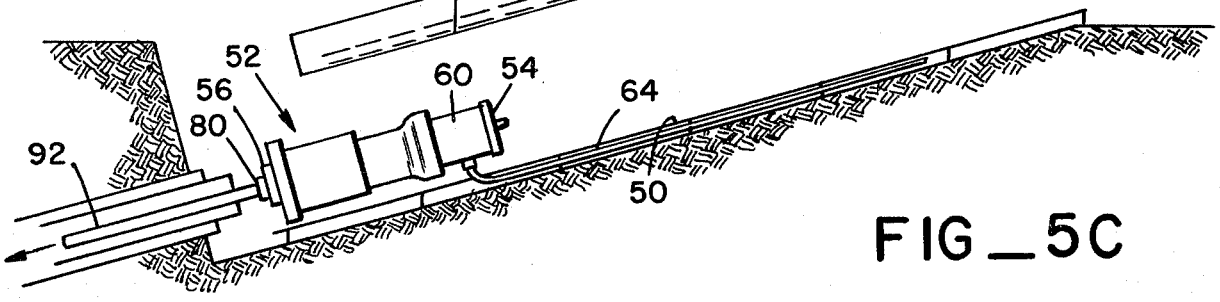
FIG_5C

APPARATUS AND PROCESS FOR DRILLING UNDERGROUND ARCUATE PATHS UTILIZING DIRECTIONAL DRILL AND FOLLOWING LINER

BACKGROUND OF THE INVENTION

This invention relates to directional drilling. More particularly, this invention relates to a directional drilling apparatus and process in which a following liner is used.

SUMMARY OF THE PRIOR ART

In conventional vertical drilling, the use of lining pipes circumscribing a drill string in the form of "overshoes" is known. Such overshoes are normally used where a drilling accident occurs and a drill string has a portion of its length broken off in a vertical hole. Typically, the overshoe drilling pipe drills down concentrically about the broken section of drill string at the bottom of the hole. After drilling completely about the broken section of drilling pipe with the overshoe, conventional fishing tools can be used to retrieve the broken section of drill string to unobstruct the original and intended vertical drilling path.

It has heretofore been unknown to use such overshoes in drilling inverted arcuate paths underneath obstacles, as illustrated in my U.S. Pat. No. 3,878,903 for APPARATUS AND PROCESS FOR DRILLING UNDERGROUND ARCUATE PATHS. The purpose of the following liner in this context is to maintain the drilled hole and provide a second larger drill pipe to be used as a production casing or for subsequent reaming of the hole. Accordingly, the invention summarized hereafter is believed to radically distinguish from the known prior art.

SUMMARY OF THE INVENTION

A motor-powered directional drill is advanced in an inverted arcuate path underneath an obstacle such as a water course. A second concentric and larger lining pipe follows the advance of the directional drill either simultaneously but preferably sequentially to form a concentric annulus about the directional drill. This lining pipe preserves the directional drilling path made and prevents the collapse or the erosion of the hole due to manipulation of the directional drill. When the inverted path underneath the obstacle is completed and the liner extends the full length, the liner becomes a large diameter pipe of improved tortional capability which can be used subsequently to ream the hole to full size for placement of a production casing. A specialized drilling rig is provided having one advancing chuck for crowding the directional drill into the ground and another larger rotating chuck to rotate and advance the following lining pipe into the ground concentrically about the directional drill.

OTHER OBJECTS AND ADVANTAGES OF THE INVENTION

An object of this invention is to disclose the use of a following liner to assist a directional drill. According to this aspect, the directional drill is advanced in a leading relation into the ground and manipulated to achieve the desired path. Thereafter, and preferably in sequence behind a directional drill, a following liner is inserted for a portion, but less than all, of the length of the directional drill string in the ground.

An advantage of the following lining pipe is that even when the directional drill string is withdrawn, the directionally drilled hole will stay open in the ground, at least for the length of the following liner.

A further advantage of this apparatus is that columnar failure of the directional drill string along a substantial length of its penetration into the ground is prevented. Where a small diameter pilot string is crowded into the ground, it cannot be subjected to columnar failure and directional deviation for at least that length which is within the following liner.

An additional advantage of the following liner is that when it is placed completely along the length of the directional drilling string, it provides a larger diameter tortionally stronger pipe in the hole. This pipe can be used either as the final production casing or, alternately, can be used for further working of the drilled inverted arcuate path, such as reaming the path into a still larger hole for the placement of a production casing.

Yet another advantage of this invention is that the likelihood of a lost hole is reduced. Where failure of the initial pilot string occurs, either through breaking, sticking or the like, the following liner preserves the drill path made at least insofar as it has penetrated along the drilled path.

A further advantage of the following liner is that it can be used for communication of mud in an annulus about the pilot string either to or from the underground site where pilot string directional drilling is occurring. Cuttings can be returned from the pilot string and examined to optimize the drilling process. The drilling mud, an expensive consumable of drilling processes, can thus be processed and fully recycled. The drilled path along the length of the liner penetration into the earth is flushed clean of drilling mud so that it is fully recovered. Furthermore, the pilot string is provided with completely lubricated movement along this segment of the hole by the mud in the annulus.

A further advantage of the liner is that knifing and resultant sticking of the pilot string in the ground is prevented. Thus, where the pilot string is completely removed to alter its cutting head and thereafter reinserted into the ground, the drilled path does not become elongated in section due to the sliding passage of the drill string. Moreover, the pilot string does not tend to seat and permanently stick into the ground.

A further object of this invention is to disclose a drill rig capable of practicing the disclosed process. According to this aspect of the invention, a drilling apparatus with two discrete chucks is disclosed. The first chuck is used for crowding on a nonrotative basis a motor powered drill and following pilot string into the ground. The second chuck provides for rotation and is mounted concentrically about the pilot string. This latter chuck simultaneously rotates and advances the following liner in a concentric annulus about the pilot string. Provision is made to advance, preferably sequentially, the pilot string and following liner into the ground.

An advantage of the apparatus herein disclosed is that the improved directional process heretofore set forth in my above-referenced patent application can be practiced with this apparatus in its entirety.

A further advantage of this apparatus is that sections of pilot string and liner can be placed in concentric relation and be dropped into the path of the specialized drill rig. According to this aspect, a section of pilot string is placed interiorly of the section of liner. The drill rig is retracted its full length so that both the liner and pilot string can be connected at the ground adjacent end to the string in the ground and at the chuck end to their respective driving chucks. Thereafter, the liner is advanced for the length of the section preferbly followed by the pilot string being advanced for the length of its section. The result is the preferred sequential advance of liner and pilot string in a directional inverted underground arcuate path underneath an obstacle.

Other objects, features and advantages of this invention will become more apparent after referring to the following specification and attached drawings in which:

BRIEF DESCRIPTION OF THE DRAWINGS

FIG. 4 is an enlarged cross sectional view of the drilling head of the present invention;

FIGS. 5A–C are a series of schematic views illustrating the thrusting of the following liner into the ground, crowding of the pilot string into the ground, and insertion of a new following liner/pilot string setup respectively.

DESCRIPTION OF THE PREFERRED EMBODIMENTS

Figure 1:
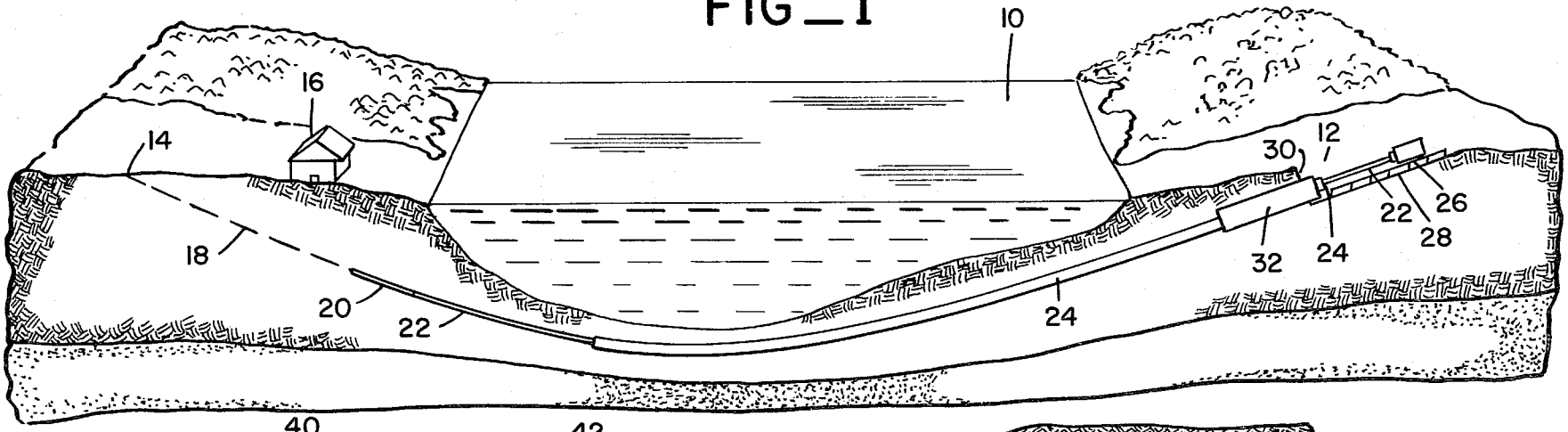
FIG. 1 is a cross sectional elevation view illustrating the operation of the present invention in drilling along an underground inverted arcuate path under an obstacle.

The operation of the present invention in drilling along an inverted underground arcuate path is illustrated generally in FIG. 1. In the situation depicted in FIG. 1, it is desired to traverse a water course 10, drilling from a first position 12 on the surface of the ground at one side of the water course to a second position 14 beyond a structure 16 at the other side. The desired path is illustrated generally by dashed line 18, and can comprise either a constant radius arc or a path of complex curvature. A pilot hole is dilled along path 18 by a directional drill 20 powered through a trailing drill string 22 which extends through the drilled hole and exits at position 12. Directional drill 20 can be controlled according to the principles set forth in my U.S. Pat. No. 3,878,903 for "APPARATUS AND PROCESS FOR DRILLING UNDERGROUND ARCUATE PATHS." Other directional drilling techniques could be used as well.

The present invention provides a following liner 24 extending from a position substantially behind directional drill 20 to the entrance 12 to the drilled hole. Following liner 24 has a larger diameter than drill string 20 so that the following liner will fit circumferentially around the drill string within the hole. During the drilling along arcuate path 18, a survey tool is periodically inserted within drill string 22 to a position immediately behind directional drill 20 to determine the current position of the directional drill. This survey tool utilizes magnetic compasses to obtain such readings, and it is necessary to have following liner 24 trail directional drill 20 for a sufficient length so that it will not interfere with the operation of the survey tool, usually by drilling the pilot hole for some distance before beginning to insert the liner. However, when directional drill 20 is to be withdrawn from the hole, such as for replacement of the drill bit, following liner 24 will maintain a substantial portion of the hole and it will no be lost. Upon reinsertion of the drill, the drill string will pass freely along liner 24 and will not seat and become stuck in the hole. Maintaining the hole is especially critical in soft sand or loose mud, as often found underneath a water course such as 10.

At the entrace position 12 of the drilled hole into the ground, an inclined drill rig 26 is positioned in a slanted hole 28. The forward surface 30 of hole 28 is normal to the initial direction of the path into the ground for ease in drilling the hole. A large diameter pipe 32 projects through surface 30 so that it is not eroded during the drilling process.

Figure 2:
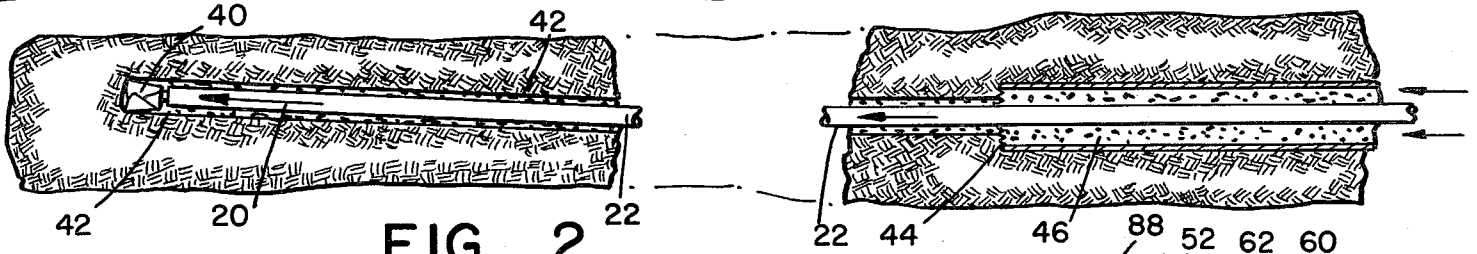
FIG. 2 is an elevation view of the leading end of the apparatus of the present invention illustrated in FIG. 1.

The leading end of the drilling apparatus illustrated in FIG. 1 is shown in more detail by way of reference to FIG. 2. Directional drill 20 has a leading drill bit 40 powered by drilling mud supplied through drill string 22. As drill bit 40 dislodges and scarifies the earth along the desired arcuate path, these cuttings are entrained in the drilling mud which flows backwardly in the small annular space 42 surrounding drill string 22. Following liner 24 is provided with a cutting edge 44 at its leading end to ream the hole to a larger diameter for accommodating the liner. The inner diameter of liner 24 is preferably greater than the outer diameter of drill string 22 so that an annulus 46 is provided therebetween. The drilling mud and the cuttings entrained therein are collected in annulus 46, and will lubricate the passage of drill string 22 within liner 24. The cuttings are allowed to settle out of the drilling mud at the entrance and the drilling mud can be reused.

Figure 3:
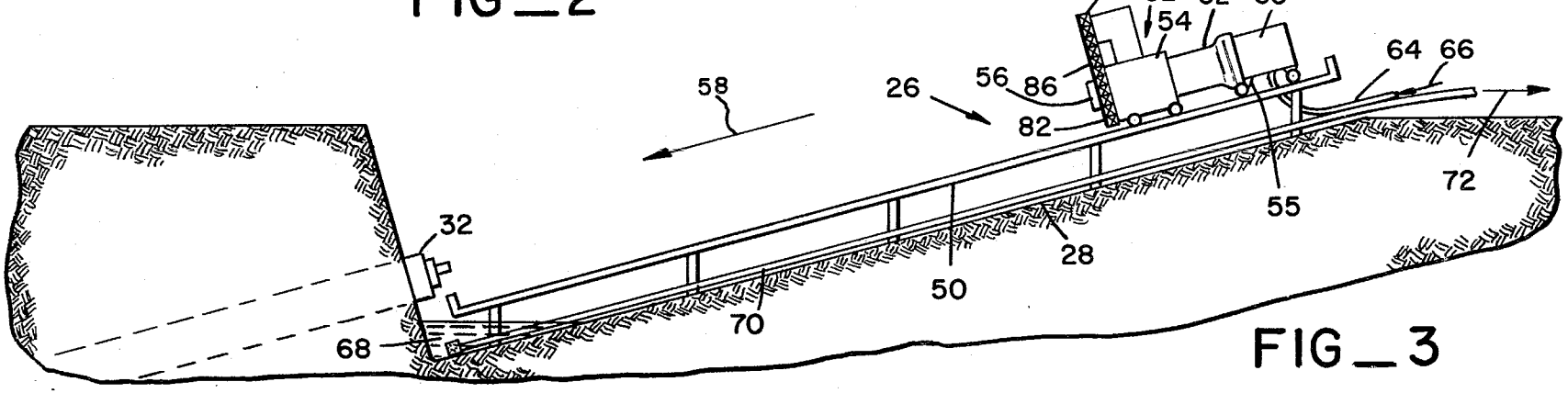
FIG. 3 is an elevation view of the drilling rig of the present invention illustrated in FIG. 1.

The drill rig 26 of the present invention is illustrated in more detail in FIG. 3. Drill rig 26 includes an inclined ramp 50 mounted to the lower surface of hole 28. A drill head 52, which will be illustrated in more detal hereinafter, is mounted on carts 54, 55 which ride along ramp 50. A rotatable chuck 56 is mounted at the leading end of cart 54 and is adapted to connect to following liner 24 for simultaneously rotating and thrusting the following liner into the ground as illustrated by arrow 58. A T-fitting 60 is mounted rearwardly of drill head 52 on cart 55. T-fitting 60 is connected to drill head 52 by a bell-shaped connection 62 which allows for rotation of the drill head relative to the T-fitting.

Drilling mud for powering the directional drill is supplied to T-fitting 60 through conduit 64 as illustrated by arrow 66. This drilling mud flows into the interior of drill head 52 and is forced through the drill string and operates a mud-driven motor in the directional drill. Used drilling mud flows out of large diameter pipe 32 and also out of the annulus between drill string 22 and liner 24 to collect in a pool 68 at the bottom of hole 28. The cuttings are allowed to settle out of pool 68, and the used drilling mud can be recycled through conduit 70 as illustrated by arrow 72 which leads to a pump which supplies the drilling mud back through conduit 64 for powering the directional drill.

The construction of drill head 52 is illustrated in more detail by way of reference to the expanded view of FIG. 4. Drill head 52 has a relatively large diameter, forwardly mounted chuck 56 adapted to connect to the trailing end of the following liner, illustrated in phantom at 24. Chuck 56 has a hollow interior open at its leading and trailing ends. In order to thrust following liner 24 downwardly into the ground, it is connected to chuck 56 which will be rotated as will be discussed hereinafter. In order to crowd the drill string into the ground, illustrated in phantom at 22, a second smaller chuck 80, also having a hollow interior, is attached to chuck 56 and is in turn connected to the trailing end of the drill string. Smaller chuck 80 is removed when following liner 24 is to be thrust into the ground.

Rotatable chuck 56 is attached to a sprocket 82 by bolts 84, 85. Sprocket 82 is driven by a chain 86 powered by a drive sprocket 88 (illustrated in FIG. 3) to rotate following liner 24 as it is thrust into the ground. When drill string 22 is to be crowded into the ground, sprocket 82 is ordinarily maintained stationary so that drill string 22 is not rotated. Drive sprocket 82 can be used to alter the azimuth of drill string 22 for controlling the directional drill according to the teachings of my above-identified copending patent application.

Chuck 56 includes a cylindrical portion 88 extending rearwardly from the leading end of the chuck. A bell-shaped housing 90 is mounted to the aft end of circular portion 88 and mates with T-fitting 60. When drill string 22 is to be crowded into the hole, a cap 94 is placed over the aft end of T-fitting 60, and drilling mud is supplied to the fitting through conduit 64 as illustrated by arrow 96. The drilling mud passes through the hollow interiors of chucks 56 and 80 and into drill string 22 to power the drill. When following liner 24 is being thrust into the hole, cap 94 is removed so that drill string 22 can project completely through chuck 56 and exit at the aft end.

The preferred sequential operation of the apparatus of the present invention is illustrated by FIGS. 5A–C in series in which the hole is partially drilled and lined. Initially, a setup including a following liner segment 90, circumscribing a drill string segment 92, is lowered over ramp 50. Segment 90 of the following liner is connected to the trailing end of the liner 24 to extend the length of the liner and drill string segment 92 is attached to the trailing end of drill string 22 to lengthen the drill string. The trailing end of liner segment 90 is connected to large diameter chuck 56 on drill head 52. The smaller chuck 80 and the cover 94 illustrated in FIG. 4 are removed.

After following liner and drill string segments 90 and 92 have been connected to drill heads 52 and 60, drill head 52 is motivated downwardly along ramp 50 as illustrated by arrow 94 in FIG. 5B to thrust following liner 24 into the hole. Chuck 56 is simultaneously rotated to facilitate movement of the liner through the ground. The position of drill string 22 remains unchanged during the thrusting of the liner and projects through drill head 52. A support 96 is provided so that drill string segment 92 does not contact the drill head.

After segment 90 of following liner 24 has been thrust into the ground, drill head 52 is returned to the aft end of ramp 50. The second smaller chuck 80 is attached to larger chuck 56, and the trailing end of drill string segment 92 is attached to the smaller chuck. Also, cap 94 is attached to the trailing end of T-fitting 60. Drill head 52 is then motivated downwardly along ramp 50 to crowd the drill string into the ground. Chuck 56 is ordinarily not rotated during this operation except to control the azimuth of the drill string. Drilling mud is supplied to T-fitting 60 through conduit 64 so that the drilling mud is forced through the drill string to power the directional drill.

Following the advancement of drill string segment 92 and following liner 90 into the ground, a new setup 100 consisting of a new following liner segment 102 circumscribing a new drill string segment 104 is ready to be lowered in place by hoist 106. Drill head 52 is returned to the aft end of ramp 50 so that the new following liner and drill string segments can be attached to the following liner and drill string respectively, and thereafter advanced into the ground to continue the drilling operation.

While the preferred embodiment of the present invention has been illustrated in detail, it is apparent that modifications and adaptations of that embodiment will occur to those skilled in the art. For example, it is apparent that a drill head could be devised in which the drill string segment and the following liner segment are simultaneously thrust into the hole. However, it is to be expressly understood that such modifications and adaptations are within the spirit and scope of the present invention, as set forth in the following claims.

What I claim as new is:

1. A method for drilling along an inverted underground arcuate path beneath an obstacle from a first position at or near ground level on one side of the obstacle to a second position at or near ground level on the other side thereof, said method comprising the steps of providing a pilot drill string of a first diameter; providing a directional drill head having at least one cutting drill bit at the leading end of said pilot drill string; crowding and directing said drill string into the ground from said first position on said one side of the obstacle and along said inverted arcuate path and simultaneously powering said drill bit to drill a pilot hole directionally along said path; providing a following liner of second and larger diameter mounted circumferentially about said drill string, the inside diameter of said following liner exceeding the outside diameter of said drill string; and thrusting said liner independently of said drill string into the ground in circumscribing relationship to follow said drill string and not direct said drill string to advance said liner about said drill string along the inverted arcuate path for a length less than the penetration of said pilot string into the ground.

2. A method as recited in claim 1 and additionally comprising the steps of providing a cutting head at the leading edge of the following liner and reaming the pilot hole with said cutting head to a diameter no less than the diameter of the following liner.

3. A method as recited in claim 1 and additionally comprising the step of rotating the liner simultaneously with said thrusting the liner downwardly into the ground.

4. A method as recited in claim 1 wherein powering the drill bit includes powering said drill bit with drilling mud provided through said drill string, and wherein said drilling mud is collected in the annulus between the drill string and the liner thereby lubricating the passage of said drill string within said liner.

5. A method as recited in claim 1 wherein said crowding step and said thrusting step are performed sequentially.

6. In a method for drilling an inverted underground arcuate path beneath an obstacle from a first position at or near ground level on one side of the obstacle to a second position at or near ground level on the other side thereof which includes the steps of providing a pilot drill string, providing a directional drill head at the leading end of said drill string having at least one cutting drill bit, thrusting and directing the drill string into the ground from said first position on said one side of the obstacle and along said inverted arcuate path, and powering said drill bit with drilling mud provided through said drill string simultaneously with said thrusting step to drill a directed pilot hole along said path, the improvement comprising the steps of providing a following liner of second and larger diameter than the drill string mounted circumferentially about said drill string; providing a cutting head at the leading edge of said liner; and thrusting said liner into the ground independently of said drill string in circumscribing relationship to the drill string and not to direct said drill string and simultaneously rotating said liner independently of said drill string to advance said liner from the drill string along the inverted arcuate path for a length less than the penetration of said drill string into the ground.

7. In a method for drilling an inverted underground arcuate path beneath an obstacle by drilling a pilot hole with a directional drill powered through a drill string comprising a plurality of drill string segments, the improvement of providing a following liner circumscribing the drill string comprising the steps of: providing a plurality of setups each including a following liner segment circumscribing a pilot drill string segment; sequentially interposing the respective setups at the trailing end of the drill string; introducing a first follow liner segment to follow but not direct said directional drill along said inverted arcuate path; attaching the leading ends of each drill string segment to the trailing end of the preceding drill string segment for each interposed setup to sequentially lengthen the drill string; attaching the leading ends of each following liner segment to the trailing end of the preceding liner segment for each interposed setup to sequentially form a following liner; sequentially and independently thrusting the following liner segment and the drill string segment of each interposed setup at least partially into the ground prior to interposing the next said setup.

8. A method as recited in claim 7 wherein said thrusting step includes rotating the following liner.

9. A method as recited in claim 7 wherein the inner diameter of the following liner is a preselected increment greater than the outer diameter of the drill string to provide an annulus therebetween, and wherein said thrusting step includes powering the directional drill with drilling mud provided through the interior of the drill string, and collecting said drilling mud in the annulus between the following liner and the drill string to lubricate the passage of the drill string through said liner.

10. In a method for drilling an inverted underground arcuate path beneath an obstacle by drilling a pilot hole with a directional drill powered through a drill string comprising a plurality of drill string segments, the improvement of providing a following liner circumscribing the drill string comprising the steps of:

a. providing a plurality of following liner segments and pilot drill string segments;

b. attaching the leading end of a drill string segment to the trailing end of a preceding drill string segment to lengthen the drill string;

c. attaching a leading liner segment to circumscribe but not direct said pilot drill string from a position behind said drill string;

d. attaching the leading end of a following liner segment to the trailing end of a preceding liner segment to form a following liner;

e. thrusting the following liner segment and the drill string segment at least partially into the ground prior to attaching the next subsequent drill string segment and following liner segment to advance the following liner and the drill string along the inverted underground arcuate path;

f. rotating the following liner segment as said liner segment is being thrust into the ground to facilitate the advancement of the following liner along the arcuate path; and g. thereafter repeating steps *b*, *c*, *d*, *e* and *f* to drill and direct the pilot hole and provide a following liner circumscribing the drill string as the pilot hole is being drilled.

11. A method as recited in claim 10 wherein said following liner segment and said drill string segment are sequentially thrust into the ground.

12. A method as recited in claim 10 and additionally comprising the steps of providing a cutting head at the leading edge of the following liner and reaming the pilot hole with said cutting head to a diameter no less than the diameter of the following liner.

13. A method as recited in claim 10 wherein the drill string segment is attached prior to the following liner segment.

* * * * *